United States Patent [19]

Conklin

[11] 4,019,340

[45] Apr. 26, 1977

[54] THERMAL ENCLOSURE AND METHOD

[75] Inventor: Hale Conklin, Santa Ana, Calif.

[73] Assignee: Divajex, Santa Ana, Calif.

[22] Filed: Aug. 27, 1975

[21] Appl. No.: 608,182

[52] U.S. Cl. ..... 62/371; 62/457; 62/530

[51] Int. Cl.[2] ..... F25D 3/08

[58] Field of Search ..... 62/457, 371, 530; 220/23

[56] References Cited

UNITED STATES PATENTS

| | | | |
|---|---|---|---|
| 995,188 | 6/1911 | Seely | 62/529 |
| 2,543,524 | 2/1957 | De Oliveira | 62/530 |
| 2,781,643 | 2/1957 | Fairweather | 62/530 |
| 3,255,607 | 6/1966 | Bair et al. | 62/530 |
| 3,387,650 | 6/1968 | Hoffmann et al. | 62/530 |
| 3,406,532 | 10/1968 | Rowand et al. | 62/457 |
| 3,482,418 | 12/1969 | Moore | 62/457 |
| 3,678,703 | 7/1972 | Cornish et al. | 62/371 |
| 3,791,547 | 2/1974 | Branscum | 62/371 |

*Primary Examiner*—Lloyd L. King
*Attorney, Agent, or Firm*—Gordon L. Peterson

[57] ABSTRACT

A thermal enclosure comprising a container having a cover which is removable to provide access to the interior of the container. The cover includes a frame having inner and outer ends and a passage extending through the frame. The frame includes a peripheral wall and a ledge which extends radially inwardly from the peripheral wall. An inner end wall is positioned in the passage and is supported on the ledge. An outer end wall is affixed to the peripheral wall. A material for adding or removing heat is provided in the passage between the end walls.

16 Claims, 6 Drawing Figures

THERMAL ENCLOSURE AND METHOD

BACKGROUND OF THE INVENTION

Thermal enclosures are used to keep the contents of the enclosure at a temperature other than ambient for as long a period as possible. A thermal enclosure is a container, one wall of which contains means for adding or removing heat from the interior of the container. For example, such means may include ice or materials which can be mixed to provide either endothermic or exothermic reactions. Such means may also include materials having a relatively high specific heat and/or high heat or fusion.

One material which is particularly adapted for use in a thermal enclosure is refrigerant gel. Refrigerant gel has a very high specific heat and a very high heat of fusion. Moreover, it can be readily packaged and reused, and it does not liquify when its temperature exceeds its freezing point, i.e. that temperature where a quantity of heat energy is transferred without any resultant change in temperature due to a change of state. Refrigerant gel is disclosed, by way of example, in U.S. Pat. No. 2,803,115.

One prior art thermal enclosure uses packaged refrigerant gel in the cover of a container to maintain the contents of the container cool. The cover and the refrigerant gel can be cooled in a freezer and then used to maintain a reduced temperature within the container. The cover of this prior art enclosure is hollow and includes a main section and a bottom wall. The main section has a peripheral wall and an upper wall which define a donwardly opening cavity. With the cover inverted, packaged refrigerant gel can be inserted into the cavity of the main section of the cover. Thereafter, the bottom wall is adhesively attached to the main section of the cover to enclose the opening.

With this construction, the bottom wall is outside the cavity defined by the main section of the cover. The edges of the bottom wall are exposed, and during use the bottom wall tends to peel off. The tendency of the bottom wall to separate from the main section of the cover is augmented by the weight of the refrigerant gel acting downwardly against the bottom wall. Because of the tendency of the bottom wall to separate or peel off, it must be carefully glued to the main section of the cover and held under pressure while the glue cures. Even with these precautions, the problem with bottom wall separation cannot be completely remedied.

SUMMARY OF THE INVENTION

The present invention positively prevents the bottom wall from separating from the remainder of the cover and totally eliminates the need for gluing the bottom wall. This facilitates assembly while providing a cover which is not subject to the peeling and separation problems identified above.

The present invention provides a thermal cover which includes a frame, a bottom wall, and an upper wall. The frame has inner and outer ends and a passage extending into the frame in a generally axial direction from the outer end toward the inner end. The frame includes a peripheral wall and a ledge extending radially inwardly from the peripheral wall with the ledge being located axially inwardly of the outer end of the frame.

To eliminate gluing of the bottom wall, the bottom wall is supported on the ledge. So that the edges of the bottom wall will not be exposed, the bottom wall is preferably within the passage in the frame. With this arrangement, there is no adhesive connection between the bottom wall and the frame, and the edges of the bottom wall are concealed.

The ledge provides a strong support for the bottom wall. Although the ledge may extend intermittently around the bottom wall, to provide maximum strength, it preferably extends continuously and completely around the periphery of the bottom wall. The frame can advantageously include a plurality of protrusions for positioning the bottom wall relative to the frame. These protrusions also add strength to the frame.

Means are provided in the passage of the frame for adding or removing heat. Such means include a material of the type described above such as packaged refrigerant gel.

The upper end of the passage is closed by an upper wall. The upper wall may be affixed to the frame or may be releasably mounted on the frame. One advantage of removably mounting the upper wall on the frame is that it can be removed to permit replacement of the heating or cooling material with other heating or cooling material. In addition, if the cover is removed the material such as refrigerant gel can be removed and frozen separately from the cover. This hastens the freezing of the refrigerant gel.

The bottom wall of the cover is exposed to the interior of the thermal container. Accordingly, maximum heat transfer across the bottom wall is desirable. Conversely, heat transfer through the upper wall should be retarded. For this reason, the physical characteristics of the bottom wall are such that more heat transfer can occur across the bottom wall than across the upper wall. For example, the bottom wall may be thinner than the top wall and constructed of material having greater thermal conductivity.

Another feature of the invention is the ease with which the thermal cover can be assembled. To assemble the thermal cover, the bottom wall is passed through the passage of the frame and positioned on the ledge. Next, the packaged refrigerant gel is placed on the bottom wall and finally the upper wall is mounted on the frame. This is much simpler than prior art assembly techniques which involve relatively complicated and time consuming gluing processes.

The features of the invention are particularly applicable to a thermal cover and are discussed herein with reference to a thermal cover. However, it should be understood that the invention is also applicable to any wall section, whether removable or not, of a thermal enclosure.

The invention can best be understood by reference to the following description taken in connection with the accompanying illustrative drawing.

DESCRIPTION OF THE PREFERRED EMBODIMENT

Figure 1:
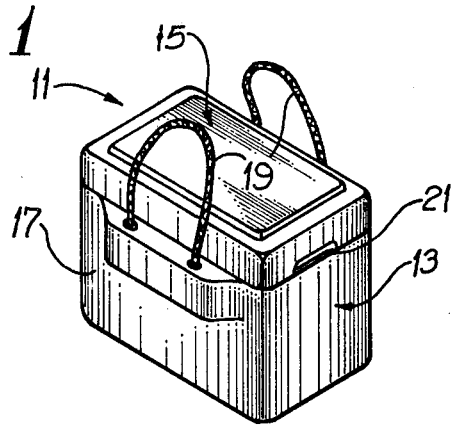
FIG. 1 is a perspective view of a thermal enclosure constructed in accordance with the teachings of this invention.

FIG. 1 shows a thermal enclosure 11 which includes a container section 13 and a removable wall section in the form of a cover 15. The container section 13 is constructed of an insulating material having low thermal conductivity such as foam plastic material. The container section 13 could be of various configurations, and in the embodiment illustrated it has a peripheral wall 17, a bottom wall (not shown), and an open top which is closed by the cover 15. The container section 13 has a pair of handles 19 and a pair of notches 21 (only one being shown in FIG. 1) to facilitate manually transporting the enclosure 11.

Figure 5:
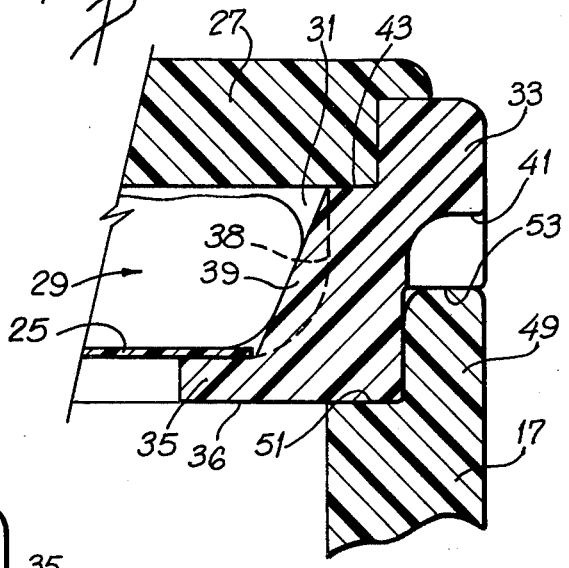
FIG. 5 is an enlarged fragmentary sectional view of a portion of the structure shown in FIG. 3 with the refrigerant gel and upper wall of the cover installed.
Figure 2:
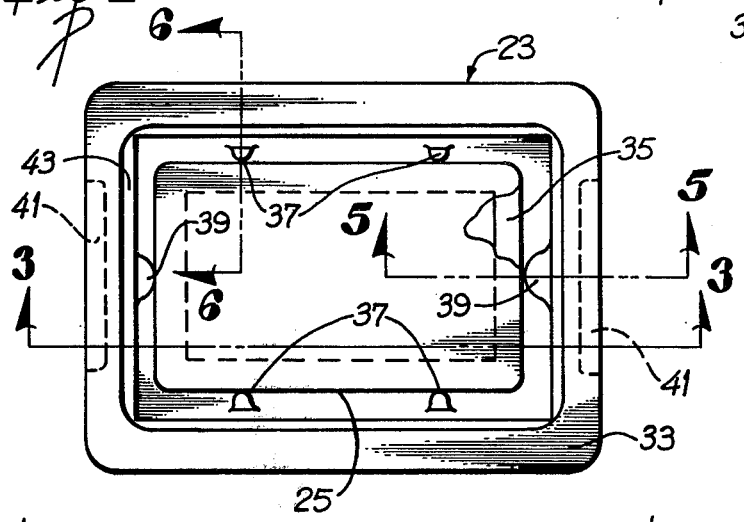
FIG. 2 is a top plan view of a thermal cover constructed in accordance with the teachings of this invention with the upper wall and the package refrigerant gel removed.
Figure 3:
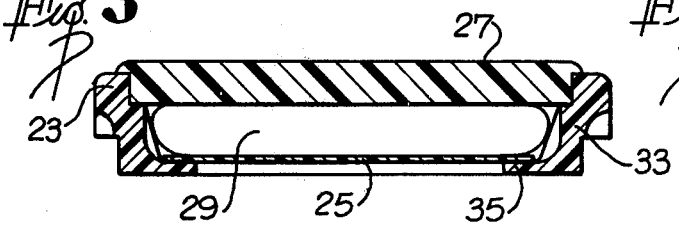
FIG. 3 is a sectional view taken generally along line 3—3 of FIG. 2.
Figure 4:
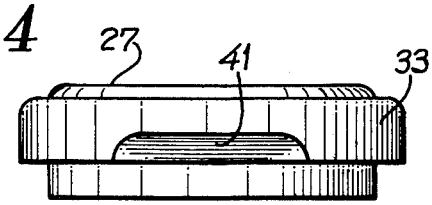
FIG. 4 is an end elevational view of the cover.
Figure 6:
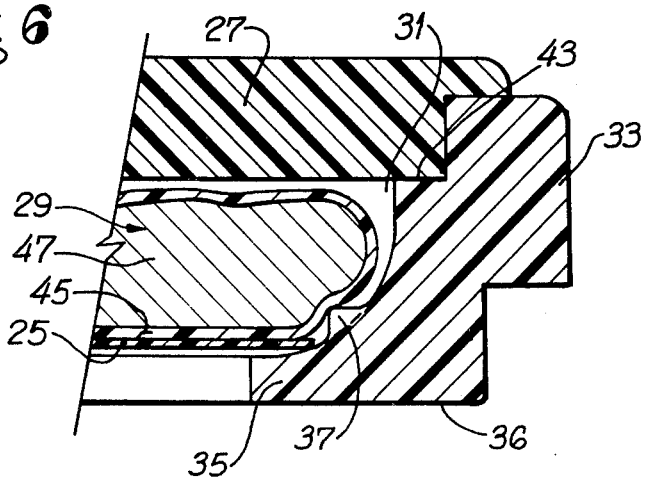
FIG. 6 is an enlarged fragmentary sectional view taken generally along lines 6—6 of FIG. 2 with the refrigerant gel and upper wall of the cover installed.

The cover 15 includes a frame 23, an inner or bottom wall 25, and outer or upper wall 27 (FIGS. 5 and 6), and means 29 for adding or removing heat (FIGS. 3, 5 and 6). The frame 23 in the embodiment illustrated is integrally molded from a suitable insulati ng material which may be foam plastic such as foam polyurethane. The frame 23 is generally in the form of a rectangular ring and has an opening or passage 31 (FIG. 5) which extends completely through it. The frame 23 includes a peripheral wall 23 which completely surrounds the passage 31 and a ledge 35 which extends radially inwardly from the peripheral wall 33. In the embodiment illustrated, the frame 23 has a lower planar surface 36 which is common to the ledge 35 and the peripheral wall 33 as shown in FIGS. 5 and 6. Although various constructions are possible the ledge 35, in the embodiment illustrated, extends continuously and completely around the passage 31 for 360°. The frame 23 has a smooth concave inner surface 38 which blends the peripheral wall 33 into the ledge 35. This curved surface provides for a stronger ledge than if a notch existed between the ledge and the peripheral wall.

A plurality of protrusions 37 (four being illustrated) are provided along the opposite longitudinal sides of the peripheral wall 33. A pair of protrusions 39 are molded integrally with the end walls of the peripheral wall 33. At its opposite ends, the peripheral wall 33 has cavities which define hand holds 41.

The bottom wall 25 may be of various materials and configurations. In the embodiment illustrated, the bottom wall 25 is in the form of a thin rectangular plate of plastic material. A peripheral portion of the bottom wall 25 rests on and is supported by the ledge 35. The ledge 35 is relatively thick and provides a strong support for the bottom wall 25. As best seen in FIGS. 5 and 6, the bottom wall is spaced axially from the lower surface 36.

The upper wall 27 can advantageously be molded from an insulating material such as foam polyurethane. The peripheral wall 33 has a shoulder 43 which is above the ledge 35 and which extends completely around the passage 31. The upper wall 27 is partly received in the passage 31 and rests on the shoulder 43. The upper wall 27 may be snugly received in the passage 31 in which event the cover 27 is manually removable. Alternatively, the cover 27 may be adhered to the shoulder 43 and/or other contiguous surfaces of the frame 33.

The means 29 for adding or removing heat may be any material or combination of materials which will perform this function. For example, the means 29 may be any of the materials described above as being suitable for this purpose. In the embodiment illustrated, the means 29 includes packaged refrigerant gel. Specifically, the packaged refrigerant gel includes a flexible plastic container 45 (FIG. 6) filled with refrigerant gel 47. The refrigerant gel may be of the type commercially available from Divajex of Santa Ana, California. Such gel includes large amounts of water and means to hold the water. The container 45 and the gel 47 are within the passage 31 and are supported by, and rest on, the bottom wall 25.

The cover 15 may cooperate in any suitable way with the peripheral wall 17 of the container section 13 to close the opening in the container section. In the embodiment illustrated, the peripheral wall 17 includes a narrow axial extension 49 (FIG. 5) and a shoulder 51. The peripheral wall 33 has an overhang 53. The cover 15 is partially received by the extension 49, and the lower surface 36 and the overhang 53 rest on the shoulder 51 and the upper end of the extension 49, respectively.

In use the cover 15 is placed in a freezer to freeze the refrigerant gel 47. Thereafter, the cover 15 is placed on the container section 13 and the thermal enclosure 11 can maintain the contents of the enclosure at a reduced temperature. If the upper wall 27 is removable from the frame 23, the refrigerant gel 47 and its container 45 can be removed from the cover 15 and frozen.

To assemble the cover 15, the bottom wall 25 is placed into the passage 31 from the upper end and positioned on the ledge 35. The bottom wall 25 is sized to be received between the protrusions 37 and 39, and accordingly these protrusions help position the bottom wall on the ledge 35. Next, the heating or cooling means 29 is inserted into the passage 31 from the upper end of the passage, and finally the upper wall 27 is mounted on the frame 23 by inserting it into the passage 31. If desired, the upper wall 27 may be adhesively attached to the peripheral wall 33.

Although an exemplary embodiment of this invention has been shown and described, many changes, modifications, and substitutions may be made by those with ordinary skill in the art without necessarily departing from the spirit and scope of this invention.

I claim:

1. A wall section for a thermal enclosure comprising:

a frame having inner and outer ends and a passage extending into said frame in a generally axial direction from said outer end toward said inner end;

said frame being integrally molded from an insulating material and including a peripheral wall and a ledge exposed within the peripheral wall, said ledge being axially inwardly of said outer end;

an inner wall having an edge portion, said edge portion being supported by said ledge and being intermediate the ledge and the outer end of said frame;

an outer wall affixed to the frame and closing the passage at a location spaced axially outwardly from said inner wall;

first means in said passage at least partially between the outer wall and the inner wall for adding heat or removing heat; and the physical characteristics of the inner wall and the outer wall being such that more heat transfer occurs across the inner wall than across the outer wall.

2. A wall section as defined in claim 1 wherein each of said frame, said inner wall, and said outer wall is a separate member and said passage has dimensions which are sufficient to permit said inner wall to be inserted into said passage at said outer end and moved through said passage to said ledge.

3. A wall section as defined in claim 1 wherein said first means includes a container and material in said container for adding or removing heat.

4. A wall section as defined in claim 3 wherein said material includes water.

5. A wall section as defined in claim 3 wherein said material includes freezable and reusable refrigerant gel.

6. A wall section as defined in claim 1 wherein said outer wall is removably affixed to the frame whereby the first means can be replaced.

7. A wall section as defined in claim 1 wherein said frame and said outer wall are constructed of plastic material and said inner wall is thinner than said outer wall.

8. A wall section as defined in claim 1 wherein the inner wall is a separate member and including protrusions on said frame for locating said inner wall relative to said frame.

9. A wall section as defined in claim 1 wherein said inner wall is a separate member and said first means includes a container and refrigerant gel in said container, said inner wall being thinner than said outer wall and being free of adhesive attachment to said frame.

10. A wall section as defined in claim 9 wherein said ledge extends substantially continuously and substantially completely around said passage, said wall section including protrusions on said frame for locating said inner wall on said frame.

11. A thermal enclosure comprising:

wall means defining a container, said container having a compartment therein;

said wall means including a wall section;

said wall section including a frame having inner and outer ends and a passage extending through said frame from said inner end to said outer end;

said frame being integrally molded from an insulating material and including a peripheral wall and a ledge exposed within the peripheral wall, said ledge being inwardly of said outer end;

an inner wall in said passage and supported by said ledge against movement inwardly beyond said ledge, said inner wall facing the compartment;

an outer wall affixed to the frame and closing the passage at a location spaced axially outwardly from said inner wall, said walls at least partially defining a cavity;

first means in said cavity for adding or removing heat; and the physical characteristics of the inner and outer walls being such that more heat transfer occurs across the inner wall to said compartment than across the outer wall.

12. A thermal enclosure as defined in claim 11 wherein said wall section is a cover which is removable to provide access to the compartment.

13. A thermal enclosure as defined in claim 12 wherein said passage has dimensions which are sufficient to permit said inner wall to be inserted into said passage at said outer end and move through said passage to said ledge, said first means includes a container and freezable and reusable refrigerant gel in said container.

14. A thermal enclosure comprising:

a container section having an open top and being constructed of a material having relatively low thermal conductivity;

a removable cover for closing said open top;

said cover including a frame having inner and outer ends and a passage extending through said frame from said inner end to said outer end;

said frame being integrally molded from an insulating material and including a peripheral wall and a ledge exposed within the peripheral wall, said ledge being axially inwardly of said outer end;

said cover including an inner wall in said passage and supported by said ledge against movement inwardly beyond said ledge;

said cover including an outer wall affixed to the frame and closing the passage at a location spaced axially outwardly from said inner wall, said walls at least partially defining a cavity;

freezable and reusable refrigerant gel in said cavity;

container means in said cavity for containing said gel; and the physical characteristics of the inner and outer walls being such that more heat transfer occurs across the inner wall to said compartment than across the outer wall.

15. A thermal enclosure as defined in claim 14 wherein said frame and said outer wall are separate members.

16. A wall section for a thermal enclosure comprising:

a frame having inner and outer ends and a passage extending into said frame in a generally axial direction from said outer end toward said inner end;

said frame including a peripheral wall and a ledge exposed within the peripheral wall, said ledge being axially inwardly of said outer end;

an inner wall having an edge portion, said edge portion being supported by said ledge and being intermediate the ledge and the outer end of said frame;

an outer wall affixed to the frame and closing the passage at a location spaced axially outwardly from said inner wall;

first means in said passage at least partially between the outer wall and the inner wall for adding heat or removing heat;

the physical characteristics of the inner wall and the outer wall being such that more heat transfer occurs across the inner wall than across the outer wall; and said inner wall being a separate member and said first means including a container and refrigerant gel in said container, said inner wall being thinner than said outer wall and being free of adhesive attachment to said frame, said ledge extending substantially continuously and substantially completely around said passage, said wall section including protrusions on said frame for locating said inner wall on said frame.

* * * * *